United States Patent [19]

Thyvold

[11] 4,016,824

[45] Apr. 12, 1977

[54] RUDDER POST TUBE ASSEMBLY

[76] Inventor: Olav Thyvold, 2891 Craigowan Road, Victoria, British Columbia, Canada, V9B 1M9

[22] Filed: Oct. 14, 1975

[21] Appl. No.: 622,378

[52] U.S. Cl. ..... 114/165; 114/39

[51] Int. Cl.[2] ..... B63H 25/06

[58] Field of Search ..... 114/162, 165, 169, 39, 114/128, 136, 137

[56] References Cited

UNITED STATES PATENTS

| | | | |
|---|---|---|---|
| 2,653,563 | 9/1953 | Long | 114/165 X |
| 2,726,621 | 12/1955 | Hill | 114/162 X |
| 3,381,649 | 5/1968 | Ward | 114/169 |

FOREIGN PATENTS OR APPLICATIONS

| | | | |
|---|---|---|---|
| 1,362,792 | 8/1974 | United Kingdom | 114/162 |

*Primary Examiner*—Trygve M. Blix
*Assistant Examiner*—Gregory W. O'Connor
*Attorney, Agent, or Firm*—Carver and Company

[57] ABSTRACT

A rudder post tube assembly for sailing craft having an inverted frusto-conical shell rotatably fitting in an inverted frusto-conical casing which opens out of the bottom of the craft. A rudder post tube is secured to the wall of the shell for rotatably supporting a rudder post of a rudder assembly so that the rudder post can be canted to port or starboard of the vertical axis of the craft by rotatably adjusting the position of the shell within the casing.

5 Claims, 7 Drawing Figures

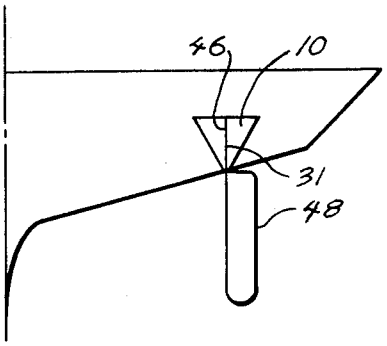
—Fig. 4—
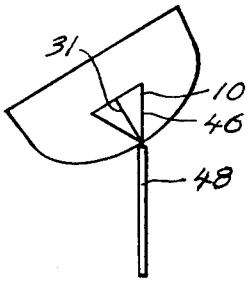
—Fig. 5—
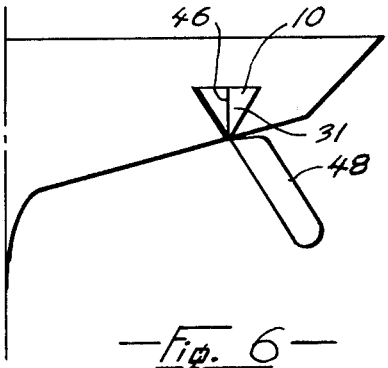
—Fig. 6—
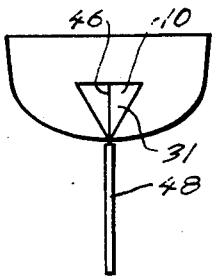
—Fig. 7—

RUDDER POST TUBE ASSEMBLY

BACKGROUND OF THE INVENTION

1. Field of the Invention

This invention relates to sailing craft and in particular to rudder assemblies thereof.

2. Prior Art

Conventionally, rudders of sailing craft have a fixed rotational axis so that when the vessel heels the rudder is, accordingly, canted. Its steering effect varies inversely relative to the heel angle thus requiring increased weather helm as heel increases. When the rudder is canted transversely steering force on the rudder upon application of weather helm is in great measure dissipated as a component of the force of water against the rudder acts upwards and increases drag thus materially reducing the speed of the craft and ultimately does cause the rudder to stall.

A further objection to the use of a fixed rudder post resides in the fact that the rudder offers, at all attitudes of the craft, a fixed frontal area. A rudder disposed with its rotational axis vertical provides optimum steering efficiency which is needed when the craft is heeling on close hauled reaches and under relatively heavy winds, however, when the craft is sailing under light winds and is not excessively heeled or sailing before the wind where steering effect of the rudder is less material the frontal area presented by a vertical rudder post adds material to drag. It is desirable, under the latter conditions, that the rudder post have a rearward sweep — slightly over 45° being considered acceptable for some types of craft — so as to thereby decrease the frontal area of the rudder and reduce drag. Designers of sailing craft have, in the past, arrived at a compromise between the two positions and very often mount the rudders so that the rudder and rudder post sweep aft at an angle of approximately 20° to 25°. With the rudder thus disposed, it is not at its optimum with respect to steering efficiency or drag under any sailing conditions.

Rudder assemblies have heretofore been developed which enable the rudder post to be adjustably canted to port or starboard so that the rudder can be disposed in a vertical plane regardless of the attitude of craft. In this type of rudder assembly, as the rudder is vertical, steering effect is optimized requiring less weather helm than in fixed craft. Power loss due to the uplifting effect of a canted rudder is also eliminated. This type of rudder assembly, however, presents a constant front area as is common with fixed rudder assemblies. The transversely cantable rudder assemblies are not suited for use in large sailing craft due to the heavy latteral forces applied to the rudder and thus are heavy and relatively unmanagable unless provided with powered adjusting devices.

SUMMARY OF THE INVENTION

The present invention provides a rudder tube assembly which not only enables the rotational axis of the rudder to be canted to port or starboard and thus enables the rudder to be disposed vertically regardless of the heel of the craft, but also enables the fore and aft sweep of the rudder to be adjusted for various sailing attitudes of the craft.

Furthermore, the rudder tube assembly of the present invention is adaptable for use in larger sailing craft and is easy to operate under severe weather conditions.

The rudder tube assembly of the present invention includes a casing in the form of an inverted frusto-cone, a shell in the form of an inverted frusto-cone rotatably fitting in the casing, means for angularly adjusting the shell member about its rotational axis and a rudder tube secured in the shell and open at both ends for rotatably receiving a rudder post of a rudder assembly, the axis of the rudder tube intersecting the axis of rotation of the shell.

A detailed description following, related to the drawings, gives exemplification of apparatus according to the invention which, however, is capable of expression in means other than those particularly described and illustrated.

DESCRIPTION OF THE DRAWINGS

FIGS. 4 and 5 are side and stem views, respectively, of a portion of the sailing craft showing, diagrammatically, the disposition of the rudder tube when the craft is heeled to port, FIGS. 6 and 7 are views similar to FIGS. 4 and 5 showing, diagrammatically, the disposition of the rudder tube when the craft is upright.

DETAILED DESCRIPTION

Figure 1:
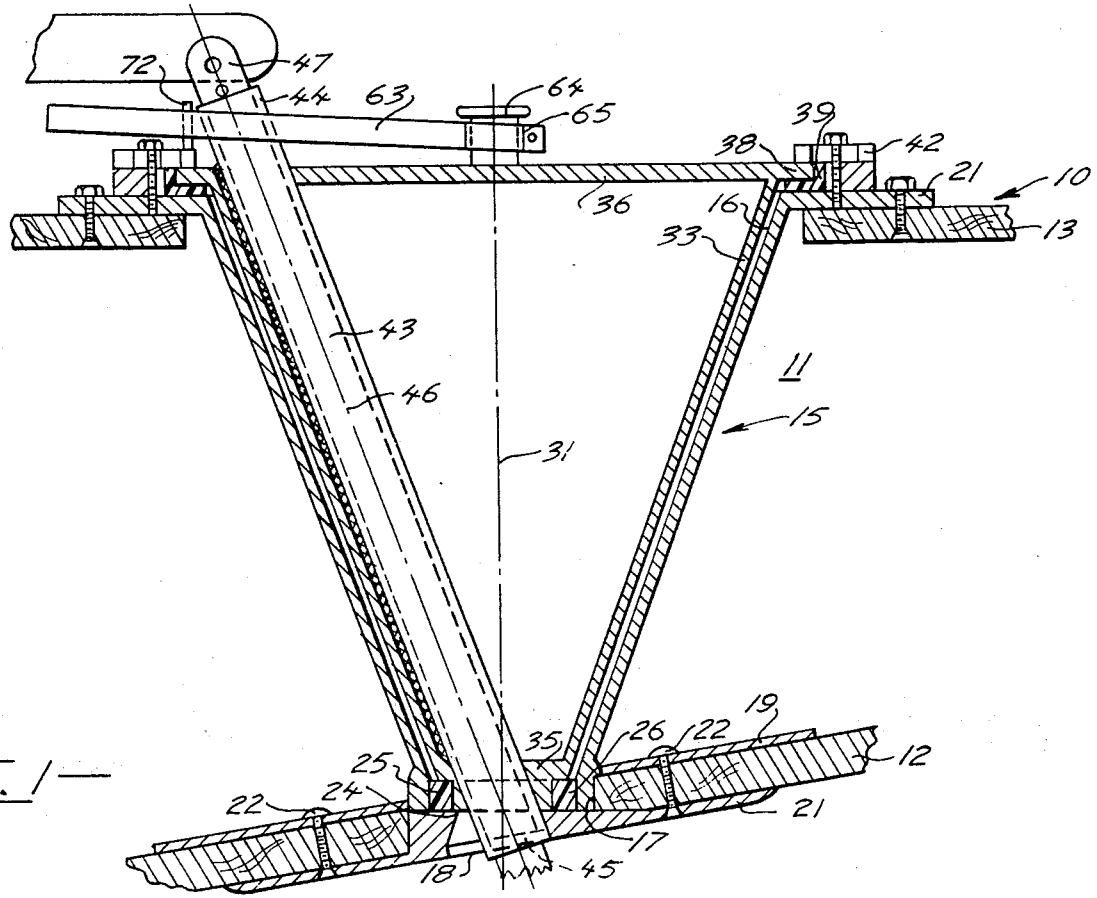
FIG. 1 is a longitudinal sectional view of the rudder tube assembly of the invention installed in the sailing craft, the latter being shown partially only.

Referring to the drawings, in particular FIG. 1 thereof, the rudder tube assembly, generally 10, is shown mounted in the stern of a sailing craft, generally 11, and shown only partially, between the craft bottom 12 and the deck 13.

The assembly 10 includes a casing 15 which can be either metal or a sufficiently strong thermoplastic which takes the form of an inverted frusto-cone open at its upper end 16 and at its lower end 17, the lower end 17 opens outward through an opening 18 in the bottom of the craft and has a circular base plate 19 which fits flush against the inside of the craft bottom. An annular backing plate 21 fits flush against the under side of the bottom and is secured by rivets 22 to the base plate 19. The backing plate 21 has an opening 24 slightly smaller than the open lower end of the well member to provide an inner annular seat 25 which accepts an annular bushing 26, the latter being formed of a resilient material such as nylon. The upper end of the casing has an external annular flange 27 which is rivetted to the deck of the craft. The well member, which has a conical angle of approximately 40 degrees, is so located that its axis 31 lies in the longitudinal vertical plane of the craft.

A frusto-conical shell 33, closed at its lower end by an end plate 35 and at its upper end by an end plate 36, rotatably fits in and is co-axial of the casing. At its lower end the shell is shaped so that it has a rotatable sealable fit within the annular bushing 26. The end plate 36 at the upper end of the shell extends outwards to provide exterior annular flange 38 which has a rotatable sealing fit in an annular bushing 39 which is held in place by an annular hold-down plate 42 which extends over the bushing 39 and which is bolted to the annular flange 38.

Provision of the bushings 26 and 39, it is seen, enables the shell to rotate within the casing and also provides a seal to prevent entrance of water into the casing.

A cylindrical rudder tube 43 is fitted within the shell and extends outwards at its upper end 44 through the upper end plate 36 and at its lower end 45 through the lower end plate 35. The tube lies against and is secured as by welding to, the wall of the shell and is so disposed that its axis 46 intersects the axis 31 of the shell and casing so that upon rotation of the shell within the casing the axis of the tube describes an inverted cone.

The rudder tube provides rotatable support for a rudder post 47 of a conventional rudder 48 (FIGS. 4 through 7 only). The rudder post is rotatably supported within the rudder tube, details of said support not being shown as such is well known in conventional rudder post and tube assemblies.

Figure 3:
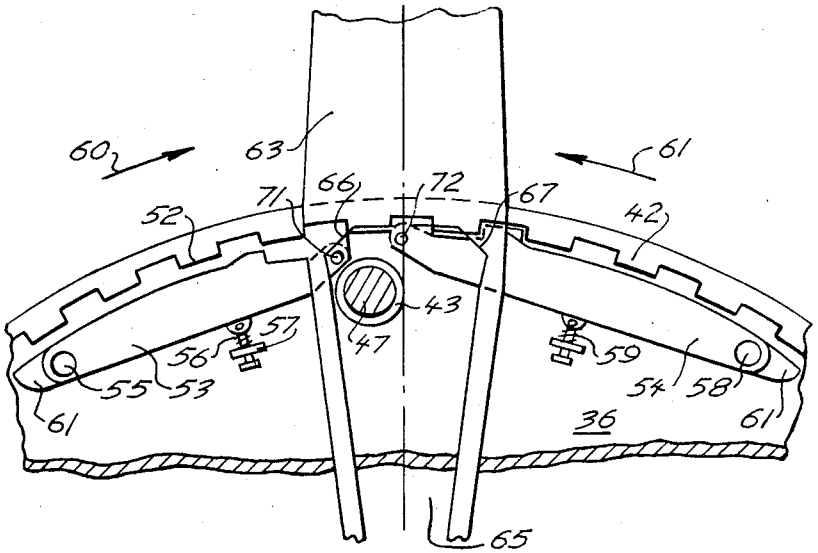
FIG. 3 is a plan view of a portion of FIG. 2, greatly enlarged.
Figure 2:
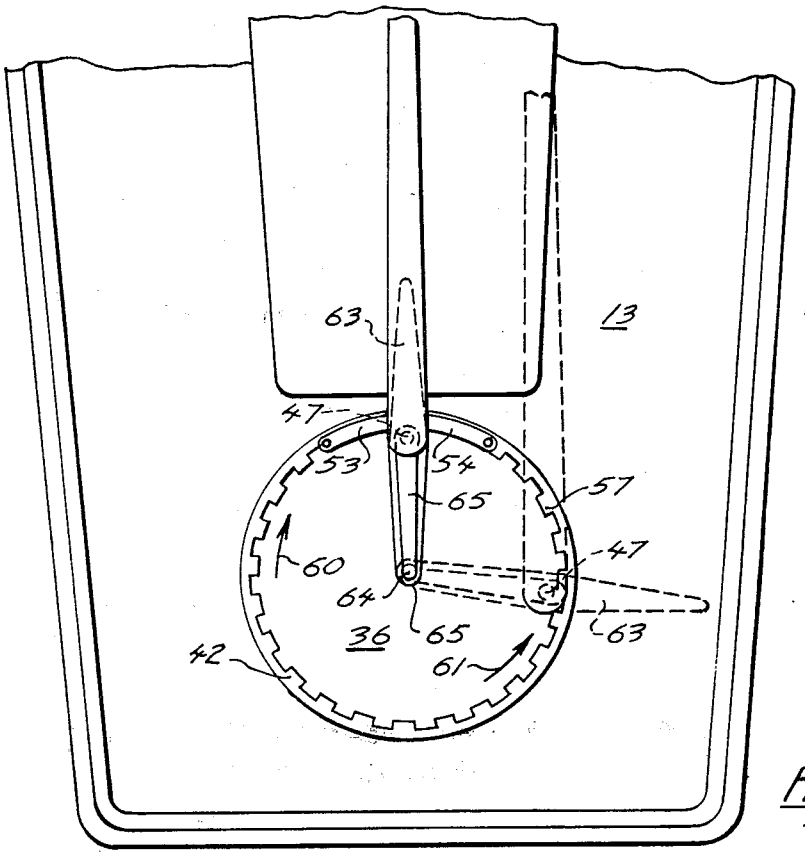
FIG. 2 is a plan view of the assembly shown in FIG. 1.

Referring also to FIGS. 2 and 3, the annular hold-down plate 42 is provided with circumferentially spaced teeth, severally 52, of rectangular configuration which are engaged by left and right pawls 53 and 54, respectively, which engage the hold-down plate. The left pawl is pivotally mounted on a pin 55 projecting from the end plate 36 and is urged against the teeth of the hold-down ring by a spring 56 which extends under compression between the pawl 53 and a bracket 57 mounted on the end plate 36. The right pawl is similarly mounted on a pin 58 and is urged into engagement with the teeth of the hold-down plate by similar compression spring 59. The left pawl, when engaged, prevents clockwise rotation of the shell, direction arrow 60; and the right pawl when engaged prevents anti-clock-wise rotation of the shell, direction arrow 61, so that with both pawls engaged the shell is releasably locked against rotation relative to the casing. Pivoted ends of the pawls rotatably bear against supporting blocks 61–61 secured to the end plate 36.

Angular adjustment of the shell about its axis can be effected by operating a lever 63 which automatically releases the appropriate pawl. As shown in FIGS. 1, 2 and 3, the upper end plate 36 is provided with a centrally located boss 64. One end 65 of the lever is rotatably mounted on the boss and has a central longitudinally extending opening 65 within which the rudder tube 44 has a loose fit so as to provide for some lost motion of the lever relative to the rudder post. The lever is provided with a pair of left and right camming surfaces 66 and 67, respectively, which can be moved within the amplitude of lost motion, into camming engagement with pins 71 and 72 projecting from the free end of the pawls 53 and 54, respectively, to swing the pawls out of locking engagement with the hold-down plate. As shown in FIG. 3, the lever 63 has been swung from a normally centered position, in a clockwise direction, to move the camming surface 66 into engagement with the pin 71 of the left pawl. This moves the left pawl out of engagement with the hold-down plate, to allow the lever to engage the rudder tube and rotate the shell in a clock-wise direction as the right pawl automatically releases when the shell is moved in this direction. When the lever is released the pawls, under the action of the springs, swing into locking engagement with the hold-down plate.

As shown in FIGS. 4 through 7, which show diagrammatically the rudder disposed in various attitudes, the assembly of the present invention not only enables the rudder to be canted to a position in which it is vertical respecting the longitudinal vertical plane of the boat regardless of the attitude of the boat, but also enables fore and aft adjustment of the rudder. When the craft is upright (see FIGS. 6 and 7) usually a position assumed by any craft when sailing before the wind, the lever (see FIG. 2, solid outline position) is positioned so that it extends forwards in alignment of the longitudinal axis of the craft. The rudder tube and rudder post are thus canted forward so as to lie in the longitudinal vertical plane of the boat so that the rudder is also vertical, as shown in FIGS. 6 and 7. When the boat takes a heeled attitude, for example heeled to port, as shown in FIGS. 4 and 5, the lever is swung to starboard, as shown in broken outline in FIG. 2, thus rotating the shell member and rudder tube and canting the rudder post to starboard so that the rudder again assumes a vertical position. With a starboard heel the lever is, of course, swung to port to verticalize the rudder. The assembly of the invention, it is seen, due to the plurality of the teeth provides for substantially infinite adjustment between the fully canted starboard and port positions.

It is seen that with the rudder tube disposed as shown in FIGS. 4 and 5, with the craft fully heeled to port, a position assumed by the craft in a close hauled starboard tack, the steering effect of the rudder is optimum. In this position the rudder is at its greatest depth of submersion and requires minimum weather helm to maintain the craft on a steady course. Although frontal area is at a maximum, loss of power to the uplifting effect of a canted rudder, common with a fixed rudder post, is eliminated.

With the craft on an even keel, as shown in FIGS. 6 and 7, a position normally assumed in light wind conditions and when the craft is sailing with the wind, in which little weather helm is required, power loss occasioned by uplifting action of the rudder is not of consequence. Rearward sweep of the rudder, however, results in reduction of frontal area with a consequent reduction of drag. In both positions effect of skin friction remains constant as the area of the rudder remains constant. It is to be understood that the rudder post can be positioned anywhere between a fully canted port or starboard position depending on the sailing attitude of the craft.

It is also apparent that as the upper end of the rudder post tube follows a circular path between its fully canted starboard and port positions the rudder will not slam into either of the fully canted positions should the pawls accidentally release and allow the shell to freely rotate. Probable damage to both craft and rudder assembly, which would probably be suffered with the transversely cantable rudder posts of prior art in the event of an accidental release is, consequently, substantially eliminated.

I claim:

1. A rudder tube assembly for sailing craft comprising:

a. a cylindrical rudder post tube for rotatably supporting a rudder post of a rudder assembly, b. means for mounting the tube in the craft for rotation such that the tube axis describes, when rotated, at least a portion of the curved surface of an inverted cone having an axis lying in the longitudinal vertical plane of the craft for enabling the rudder post to be angularly oriented relative to said plane, c. means for releasably locking the tube against rotation.

2. A rudder tube assembly for sailing craft comprising:

a. a frusto-conical shell, b. means for mounting the shell in an inverted position in the hull of the sailing craft for rotation about its conical axis, with said axis lying in the longitudinal vertical plane of the craft, c. a rudder post tube adapted rotatably to receive the rudder post of a rudder assembly secured to the shell for rotation therewith having its axis parallel to the wall of and intersecting the axis of the shell for enabling the rudder of the rudder assembly to be disposed in a vertical position independent of normal heeling angle, of the craft.

3. A rudder tube assembly for rotatably receiving the rudder post of a rudder assembly comprising:

a. a frusto-conical casing adapted to be secured in an inverted position in the hull of the sailing craft, with its axis lying in the longitudinal vertical plane of the craft, b. a frusto-conical shell mounted for rotation in the casing, c. a rudder tube secured to the wall of the shell having its axis parallel to the wall of the shell and intersecting the axis of the shell and opening at its lower end through the hull of the craft, said tube being adapted rotatably to receive a rudder post of the rudder assembly for enabling the rudder to be disposed in a vertical plane independent of normal heeling angle of the craft, d. locking means for releasably locking the conical shell against movement relative to the casing.

4. An assembly as claimed in claim 3 in which the locking means includes:

a. an annular hold-down plate secured to the upper end of the casing, the plate having inwardly projecting, circumferentially extending teeth, b. a pair of left and right pawls swingably mounted on the shell resiliently urged into locking engagement with the teeth, one pawl being adapted to prevent rotation of the shell member in one direction, the other pawl being adapted to prevent rotation of the shell in the opposite direction, c. a lever swingably mounted at one end on the shell and having an opening for loosely embracing the rudder post tube, the lever having a pair of camming surfaces, d. projecting pins on the pawls adapted for camming engagement with the camming surfaces for moving the pawls out of engagement with the teeth of the hold-down plate when the lever is operated in either direction for selectively swinging the pawls out of locking engagement with the teeth so as to enable the shell member to be rotated.

5. An assembly as claimed in claim 2 including annular sealing means at the upper and lower ends of the mounting means having a rotatable sealing tight fit at the upper and lower ends of the shell.

* * * * *